US005318264A

United States Patent [19]

Meiste

[11] Patent Number: 5,318,264

[45] Date of Patent: Jun. 7, 1994

[54] INFINITELY ADJUSTABLE SHELVING AND METHOD

[75] Inventor: Cordell E. Meiste, Morrison, Ill.

[73] Assignee: National Manufacturing Co., Sterling, Ill.

[21] Appl. No.: 975,506

[22] Filed: Nov. 12, 1992

[51] Int. Cl.[5] ..... A47G 29/02

[52] U.S. Cl. ..... 248/221.4; 52/36.5; 108/108; 248/222.3; 248/246; 248/248

[58] Field of Search ..... 248/221.4, 235, 243, 248/244, 245, 246, 247, 248, 222.1, 222.2, 222.3; 108/108; 211/187; 52/36

[56] References Cited

U.S. PATENT DOCUMENTS

| | | | |
|---|---|---|---|
| 569,270 | 10/1896 | Winslow | 248/245 |
| 2,901,206 | 8/1959 | Gredell | 248/246 |
| 2,940,718 | 6/1960 | Beal | 248/245 |
| 3,041,033 | 6/1962 | Schwartz | 248/248 |
| 3,207,100 | 9/1965 | Peacock | 248/248 X |
| 4,378,925 | 4/1983 | Griffin | 108/108 X |
| 4,775,125 | 10/1988 | Pfeifer | 248/222.1 |
| 4,903,928 | 2/1990 | Shell | 248/245 X |
| 5,116,007 | 5/1992 | Von Gunton et al. | 108/108 X |
| 5,185,971 | 2/1993 | Johnson, Jr. | 248/222.1 X |

FOREIGN PATENT DOCUMENTS

| | | | |
|---|---|---|---|
| 234585 | 3/1909 | Fed. Rep. of Germany | 248/246 |
| 280021 | 11/1914 | Fed. Rep. of Germany | 248/245 |
| 374975 | 4/1907 | France | 248/245 |
| 1376683 | 9/1964 | France | 248/244 |
| 422259 | 4/1967 | Switzerland | 248/246 |
| 943214 | 12/1963 | United Kingdom | 248/245 |
| 1560724 | 2/1980 | United Kingdom | 248/246 |

*Primary Examiner*—David A. Scherbel
*Assistant Examiner*—Derek J. Berger
*Attorney, Agent, or Firm*—Tilton, Fallon, Lungmus & Chestnut

[57] ABSTRACT

Infinitely adjustable shelving including a vertically elongated standard having a vertically elongated outwardly facing slot therein, a U-shaped bracket positionably mounted on the standard and being horizontally elongated with the proximal end (nearer the standard) being equipped with upper and lower connection means which are arranged to provide a locking force on the standard in conjunction with an intermediate protuberance on the bracket.

19 Claims, 4 Drawing Sheets

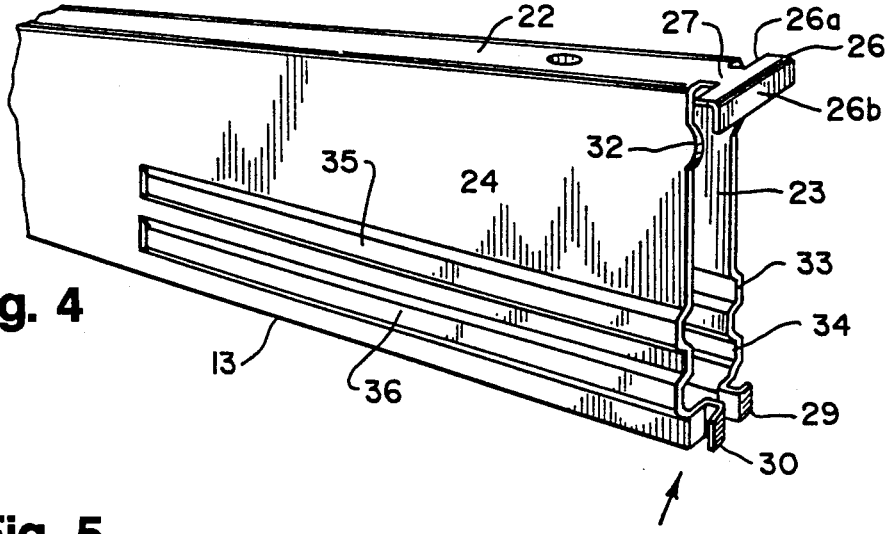
Fig. 4
Fig. 5
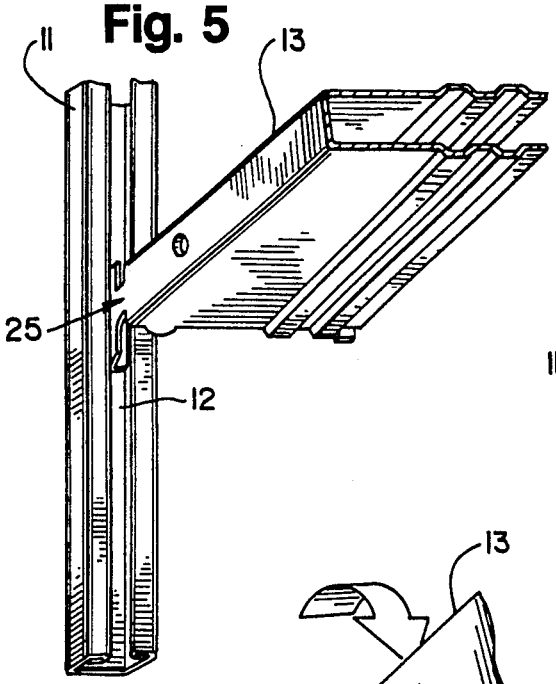
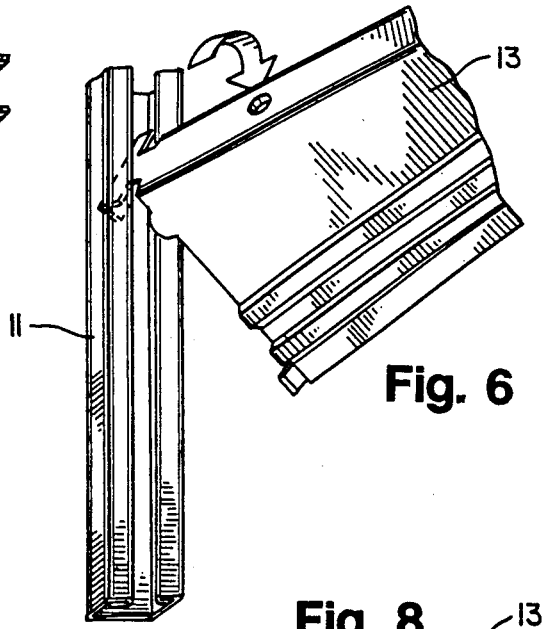
Fig. 6
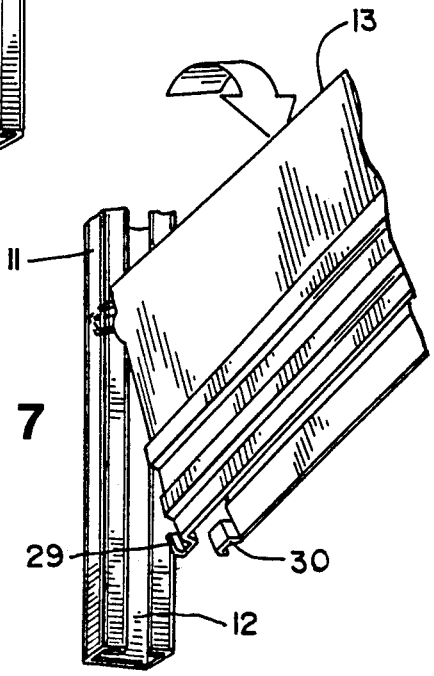
Fig. 7
Fig. 8
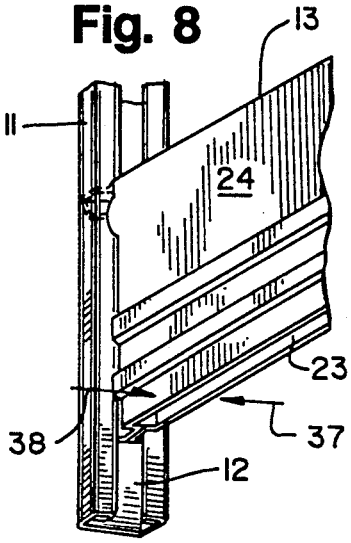

INFINITELY ADJUSTABLE SHELVING AND METHOD

BACKGROUND AND SUMMARY OF INVENTION

This invention relates to infinitely adjustable shelving and method, and, more particularly, to a system which provides for a unique engagement of a horizontal support member with a slotted vertical standard.

The invention has an advantageous application not only in garages and basements to provide wall shelving but is a quality system which can be used elsewhere in the home and business.

Infinitely adjustable support systems have been known in the past—example U.S. Pat. No. 4,779,830 which utilizes deformable plastic as the means for connecting the horizontal and vertical members. A number of problems have characterized the prior art shelving. One has to do with the difficulty in obtaining the correct position. Another is the need for close tolerances which created manufacturing problems and raised the cost of the shelving. A further problem has to do with the use of friction for anchoring the parts together which during installation or repositioning marred the paint or other finish on the standard.

The invention not only avoids the problems of tolerances and marring but provides a structure wherein the shelves are much easier to reposition. Also, the invention provides an improved way for adding brackets for an additional shelf or taking out an existing shelf to accommodate oversized books, for example. Still another advantage of the invention is that the construction can compensate for misaligned standards which has been a problem characteristic of certain types of shelving brackets and standards in the past. The mode of operation provides a unique advantage that unlike the prior art, a larger force or load on the shelving here creates more friction so that the bracket will not slide under load.

The instant invention provides a novel distribution of forces between a beam-like horizontal bracket and a column-like slotted standard to generate a reliable engagement. According to the invention, there are three bearing points which cooperate in resisting loads applied to the shelving carried by the brackets.

Each bracket, at the points of engagement has upper connection means which fit internally into the generally channel standard, an intermediate protuberance which is arranged to bear against the exterior of the standard on one of the walls defining the slot, and a lower connection means of the bracket which includes a pair of hooks adapted to flank the slot-providing walls of the standard.

Through the provision of this structure, a novel operation results. More particularly, there is a reversal of force direction at the lower connection means as the loading on the bracket is positioned further away from the standard. In all loadings, however, the force at the upper connection means is directed toward the distal or cantilevered end of the bracket. For light loadings or loadings that are close to the standard, the distally directed force at the upper connection means is effectively opposed by a proximally force exerted on the standard at the protuberance Advantageously, the protuberance is located fairly closely adjacent to the upper connection means. These forces just described at the upper connection means and the protruberance create the friction forces necessary to hold the bracket in a desired position on the standard.

Where the loading is close to the standard, for example, the force direction on the lower connection means is also directed distally or away from the standard. Thus, there are upper and lower forces creating friction which are directed away from the standard and an intermediate force at the protuberance which is directed toward the standard and in cooperation with the other two forces develops advantageous holding power.

In the instance where the loading is significantly away from the standard—as is the case with a substantial load near the cantilevered end of the bracket or the shelf carried by the bracket—the force direction at the lower connection means is reversed from that just described. In other words, the force direction is proximally and thus extends in the same direction as that previously exerted through the protuberance In such a situation, the combination of the opposing forces through the upper and lower connection means provide a strong frictional engagement of the bracket with the standard so as to resist the additional loading developed near the end of the bracket.

Other objects and advantages of the invention may be seen in the details of construction and operation set forth hereinafter.

BRIEF DESCRIPTION OF DRAWING

The invention is described in conjunction with an illustrative embodiment in the accompanying drawing, in which—

FIG 4. is a perspective view of the bracket as seen from the proximal end;

FIGS. 5-8 are perspective views of the steps of assembling the inventive shelving;

DETAILED DESCRIPTION

Figure 1:
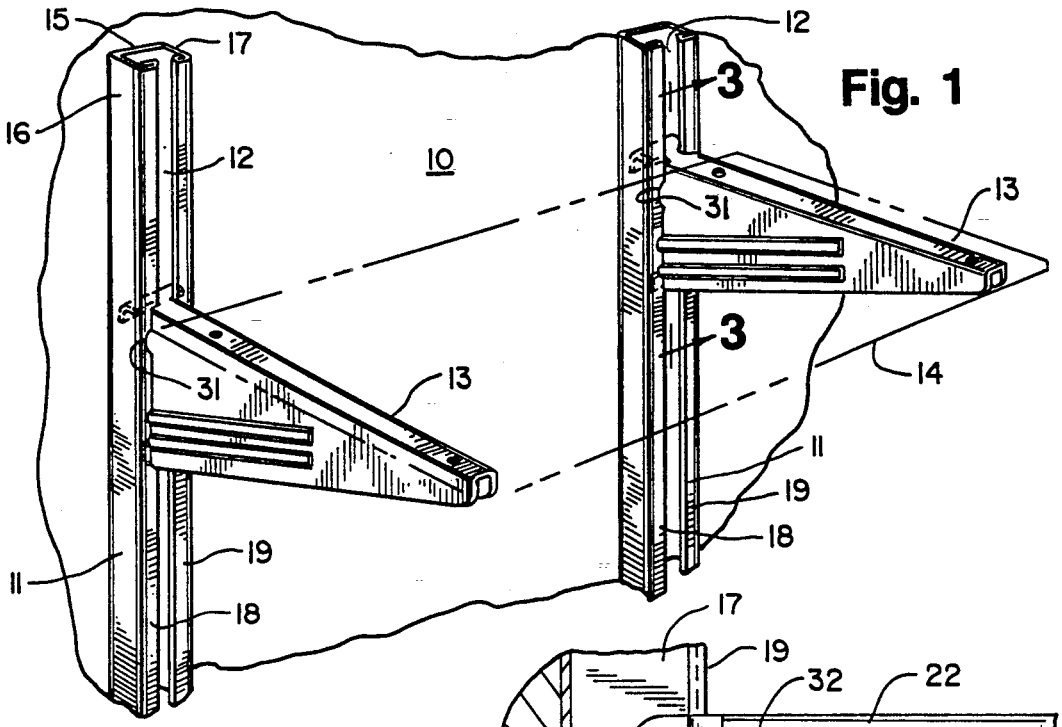
FIG. 1 is a fragmentary perspective view of shelving constructed according to the teachings of the invention.

In the illustration given and with reference first to FIG. 1, the numeral 10 designates a fragment of a wall which can advantageously support the shelving system. It will be immediately appreciated that not only may the components be wall mounted but also assembled as free standing or as a combination of both. For example, the system may utilize leg supports which may be mounted to a wall yet stand on the floor to increase load capacity. In such a fashion, this will supply sufficient strength to support heavy objects, work surfaces, cabinets, etc.

Figure 2:
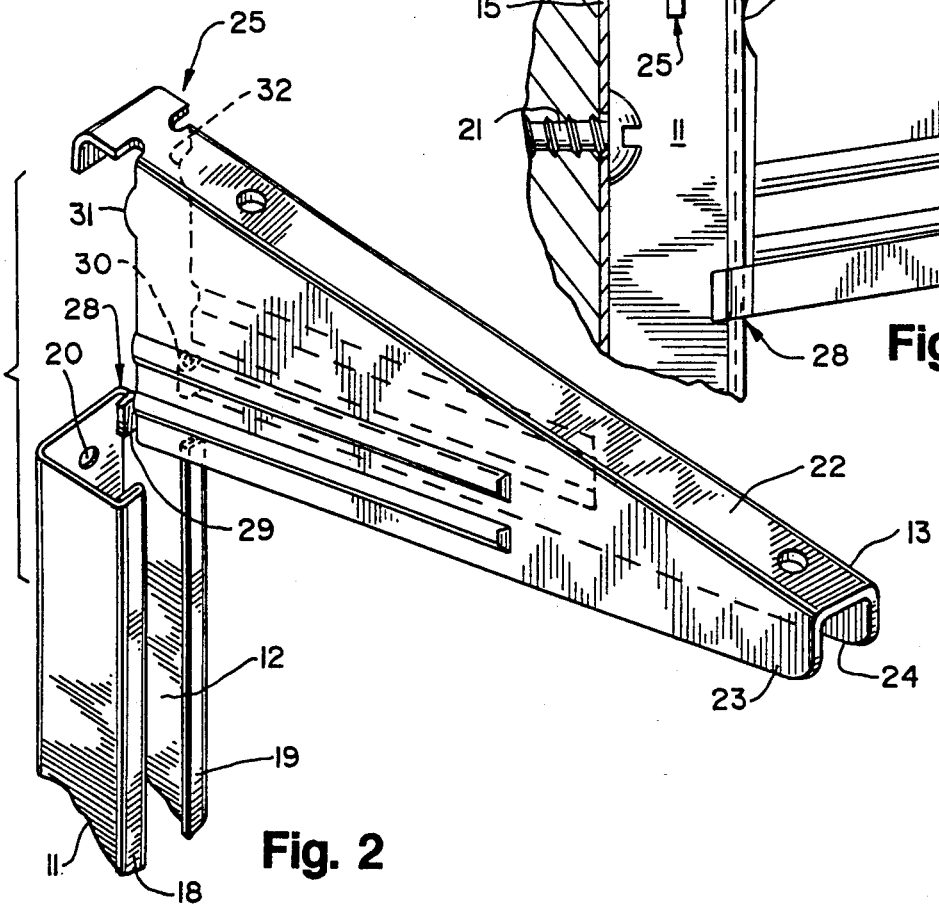
FIG. 2 is an exploded perspective view showing the two primary elements of the support system, viz., the standard and the bracket.

The principal vertical members are standards 11 which also can be seen in enlarged form in the lower portion of FIG. 2. Each standard is equipped with a relatively elongated slot 12 in which a portion of a bracket 13 is received.

As illustrated in FIG. 1, two standard/bracket assemblies are provided and shown in dotted line is a typical shelf 14 which can be advantageously carried by the brackets 13. For the storage and shelving in the garage or basement, the inventive system may utilize metal shelves along with other steel components. The system may also utilize plywood, wire shelving or composite board for the shelves in place of steel.

Turning now to FIG. 2, the standard 11 is seen in larger scale and is seen to be generally channel-like or C-shaped in transverse section. This is provided by a rear wall or bight 15, a pair of forwardly projecting walls 16, 17 and a pair of opposed, spaced apart flanges or wall portions 18 and 19. The wall portions 18, 19 define therebetween the previously referred to slot 12.

In the illustrated embodiment, the slot is extended the entire length of the standard 12 but in some instances it may be terminated above the bottom of the standard 11 to provide additional rigidity. In any event, the slot is continuous and thereby affords the infinitely adjustable feature of the invention—this in contrast to the spaced apart, aligned slots of much of the prior commercial art relating to shelving. In the illustrated embodiment, the wall portions 18, 19 all of double thickness—as by folding the wall portions on themselves as at 18' and 19' in FIG. 11. Further, a number of bolt openings as at 20 are provided in wall 15 (see FIG. 2) for attaching the standard 11 to the wall 10 as by screws 21.

Now referring to FIG. 4 and the upper portion of FIG. 2, the bracket 13 will now be described. As in the case of the standard 11, the bracket 13 is a unitary member which also can be advantageously constructed of steel such as 0.042" thick cold rolled steel. In contrast to the standard 11 which is elongated vertically, the bracket 13 is elongated horizontally and its main portion is generally channel-shaped in that it is defined by an upper bight 22 and a pair of depending flanges 23 and 24. As illustrated in FIGS. 1 and 2, the flanges 23, 24 taper in height in proceeding away from the standard 11 and for this purpose, the lower edges of the flanges 23, 24 are upwardly inclined. This provides the bight 22 generally parallel with the floor, resulting in a flat, stable surface for supporting any shelf or the like.

Figure 3:
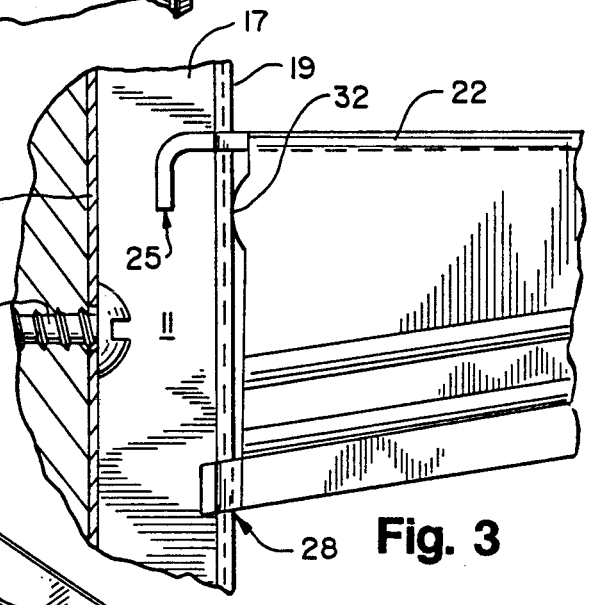
FIG. 3 is an enlarged sectional view such as would be seen along the sight line 3—3 of FIG. 1.

Extending proximally, i.e., away from the distal or projecting end of the bracket 13 (and toward the standard 11) is a generally T-shaped integrally projection constituting upper connection means generally designated 25. As can be appreciated from the upper left hand portion of FIG. 2, the projection 25 is an extension of the bight 22. As seen in FIG. 3, the projection 25 fits within the hollow channel shaped standard 11. The T-shape includes a bar 26 and a neck like part 27. The distal edges 26*a* of the bar 26 provide shoulders which bear against the interior surfaces of the wall portions 18, 19—as against the folded over parts 18' and 19' as seen clearly in FIG. 11.

Cooperating with the projection 25 is first, a lower connection means generally designated 28, which includes extensions of the flanges 23 and 24 and which terminates in a pair of hooks 29, 30; and second, a pair of protruberances 31, 32 which are located closely adjacent to the first connection means 25.

As will be explained hereinafter, the depending flanges 23, 24 are squeezed together adjacent the lower proximal ends thereof so as to permit the hooks 29, 30 to enter the slot 12. This squeezing step is facilitated by constructing the bracket 13 of resilient material such as the above-mentioned steel which also affords substantial strength to the overall assembly. Further rigidification is provided the bar 26 by the depending flange 26*b* (see FIG. 4). The bracket 13 is rigidified by ribs 33, 34, 35 and 36 which extend partway of the length from the proximal end—again see FIG. 4.

Installation

The installation of each bracket 13 on its associated standard 11 can be appreciated from the sequence of views in FIGS. 5–8. In FIG. 5, the installation of the upper protection 25 is illustrated. For this purpose, the bracket 13 has been pivoted 90° so that the "height" of the bracket now extends horizontally rather than vertically as illustrated in the preceding views FIGS. 1–4. This permits the bar 26 of the projection 25 to enter the slot 12 as illustrated. Alternatively, if the bracket is not rotated 90°, the upper connecting means 25 can be introduced into the upper end of the standard 11.

Thereafter, as illustrated in FIG. 6, the bracket is rotated back so as to bring the depending flanges 23, 24 into a vertical orientation. This is concluded when the hooks 29, 30 are aligned with the slot 12 in the standard 11 as illustrated in FIG. 7.

Thereafter, as illustrated in FIG. 8, the bracket flanges 23, 24 are squeezed together adjacent the bottom proximal ends thereof to allow the hooks 29, 30 to pass through the slot 12—the squeezing being indicated by the arrows 37, 38. Thereafter, the U-shaped hooks spring apart to clamp the wall portions 18, 19 in the fashion indicated in FIG. 2.

Figure 9:
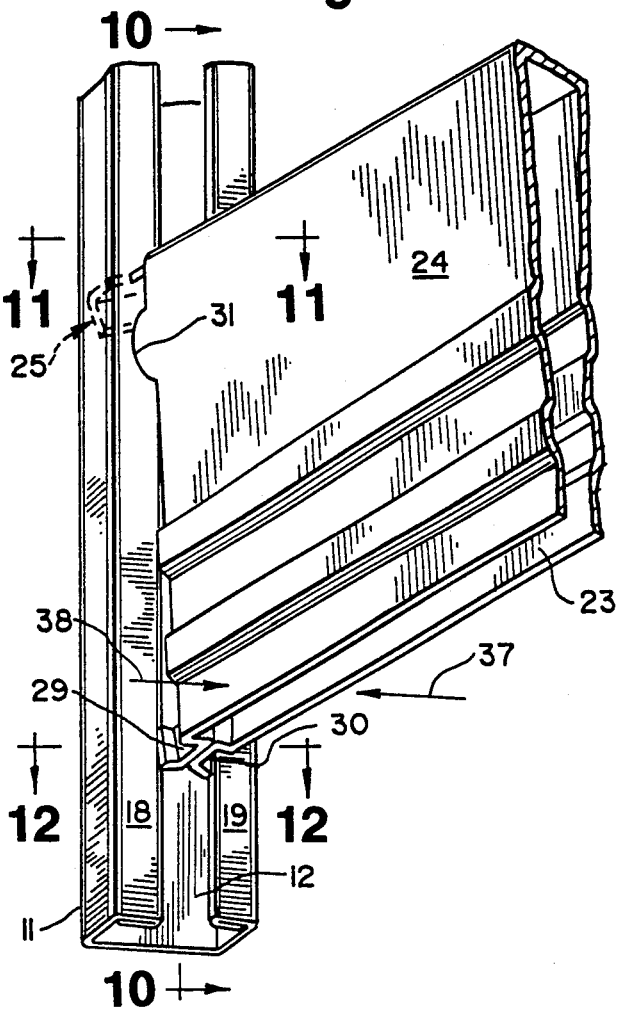
FIG. 9 is an enlarged perspective view of the bracket and standard in an orientation just prior to that depicted in FIG. 8—i.e., the bracket in a position between the positions it has in FIG. 7 and FIG. 8.

Referring to the third drawing sheet and more particularly FIG. 9, there is shown a perspective view similar to that depicted in FIG. 8 but showing the condition of the bracket relative to the standard shortly before the orientation seen in FIG. 8. In particular, the ends of the hooks 29, 30 are not completely received within the standard 11 but are seen to be aligned with the wall portions 18, 19—see particularly FIG. 12. However, at this stage, the protuberances 31, 32 are in contact with the wall portions 18, 19. Thus, there is required a certain amount of force to cause the hooks 29, 30 to enter into the standard. This is readily achieved through flexure of the standard and especially with the protuberances 31, 32 being located closely adjacent to the upper connecting means 25. I have found it advantageous to provide the protuberances 31, 32 at least in the upper half of the bracket but optimally within the upper one-third of the bracket height. With the protuberances 31, 32 positioned lower, greater force is required to cause the hooks 29, 38 to proceed further inwardly from that shown in FIG. 9.

Figure 11:
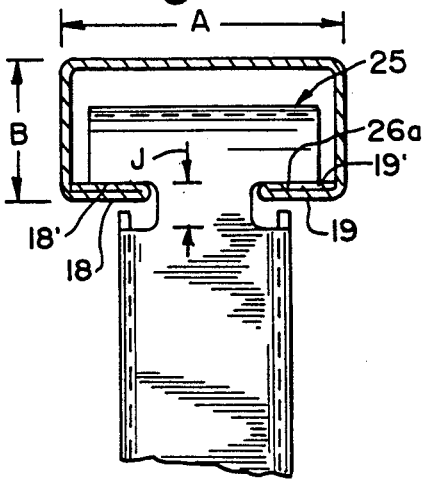
FIG. 11 is a horizontal sectional view just above the upper connecting such as would be seen along the sight line 11—11 of FIG. 9.
Figure 10:
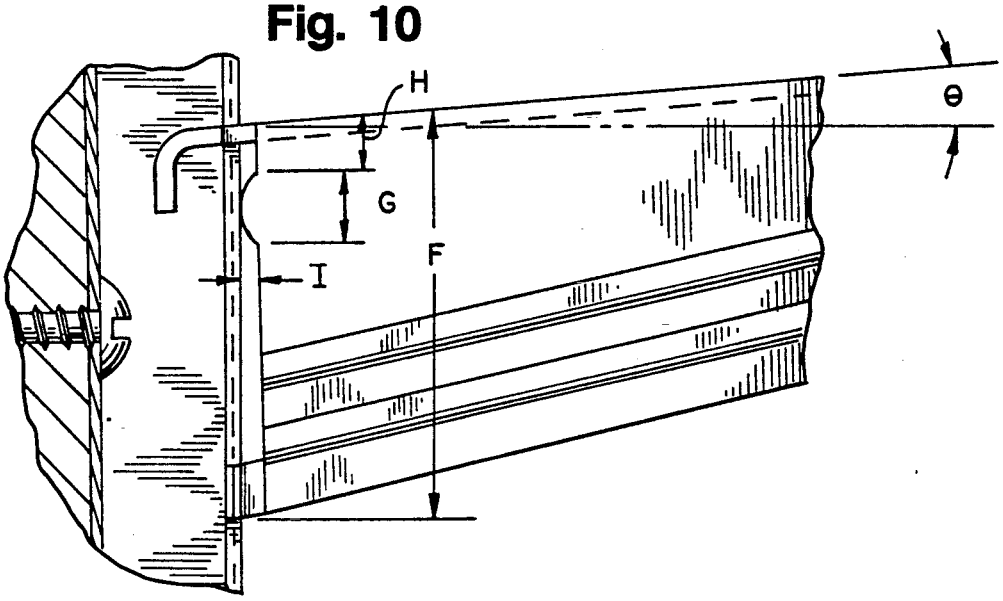
FIG. 10 is a vertical sectional view of the showing of FIG. 9 such as would be seen along the sight line 10—10 of FIG. 9.

As seen in FIG. 10, the bracket 13 is at an angle $\theta$ to the horizontal, i.e., a few degrees above horizontal. Thus, the distal end of the bracket 13 is slightly above horizontal. Also seen in FIGS. 10 and 11 is the fact that there is a substantial clearance or tolerance provided between the connection means 25 and the standard 11—notably the wall portions 18, 19. As seen in FIG. 11, the distal surfaces 26*a* of the bar 26 of the T-shaped projection constituting the upper connection means 25 are bearing against the interior of the folded over parts 18', 19'. The generosity of the tolerances is reflected by the fact that there is a substantial spacing between the slots defining the T-shape and the outer surface of the wall portions 18, 19. This is a distinct advantage of the invention because it permits the manufacture without attention to expensive tolerances.

Illustrative of an operative embodiment are the dimensions set forth in the following table and keyed to the drawing:

| Designation | FIG. Location | Description | Dimension |
|---|---|---|---|
| A | 11 | Width of standard | 0.85" |
| B | 11 | Depth of standard | ½" |
| C | 12 | Width of slot 12 | 0.35" |
| D | 13 | Length of bracket | 12", 10" 8" 6" |
| E | 14 | Bracket height (distal end) | ½" (approx. 12" size) |
| F | 10 | Bracket height (proximal end) | 2⅜" |
| G | 10 | Protuberance height | 0.28" |
| H | 10 | Spacing of protuberance from top of bight | 0.16" |
| I | 10 | Max. Radius of Protuberance | 0.04" |
| J | 11 | Lngth of neck 27 | 0.12" |
| K | 12 | Depth of hook 30 or 31 | ⅛" |
| L | 12 | Width of hook | 3/16" |

These forgiving tolerances also permit the installation and repositioning of the bracket without doing any injury to the paint or other finish of the standard. Historically, this has been a problem with readily positionable brackets utilizing frictional engagement because of the need for tight contact generally results in scratching or marring of the finish on the standard incident to repositioning or installation.

Figure 12:
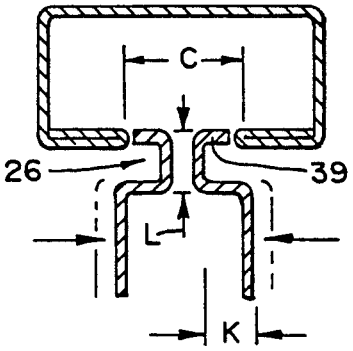
FIG. 12 is another horizontal sectional view but this through the lower connecting means such as would be seen along the sight line 12—12 of FIG. 9.

FIG. 12 shows the arrangement of the elements at the lower connecting means 26 at the time just prior to the entry of the hooks into the standard. At this point in time, the lower ends of the bracket are squeezed together and which facilitates easy insertion of the lower connecting means into the standard 11. Usually the proximal legs 39 (see FIG. 12) of the U-shaped hooks 29, 30 are just about aligned with the wall portions 18, 19 when the protuberances 31, 32 just contact these wall portions.

Repositioning

Figure 13:
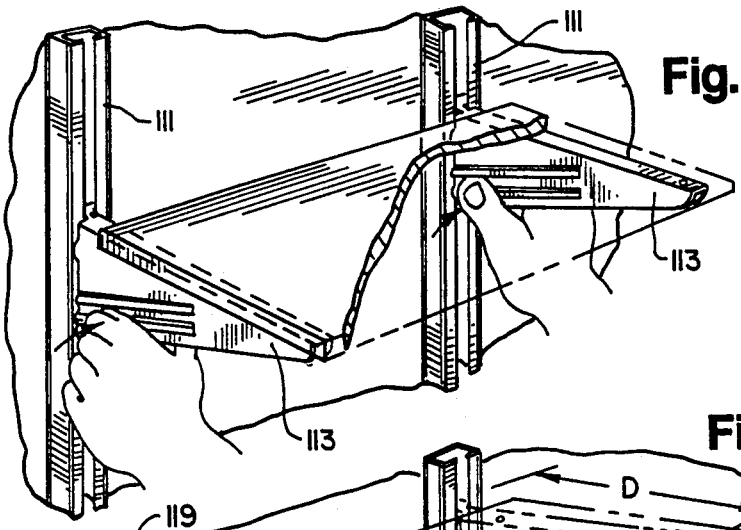
FIG. 13 is a perspective view similar to that of FIG. 1 and is the initial showing of a sequence of views depicting the repositioning of the shelving and features squeezing forces being applied to the two brackets preparatory to repositioning the same.

This is explained in conjunction with a sequence of perspective views seen in FIGS. 13–17. In FIG. 13, a view is presented that is similar to that seen in FIG. 1 but with the brackets 113 being squeezed so as to loosen the brackets from their respective standards 111.

Figure 14:
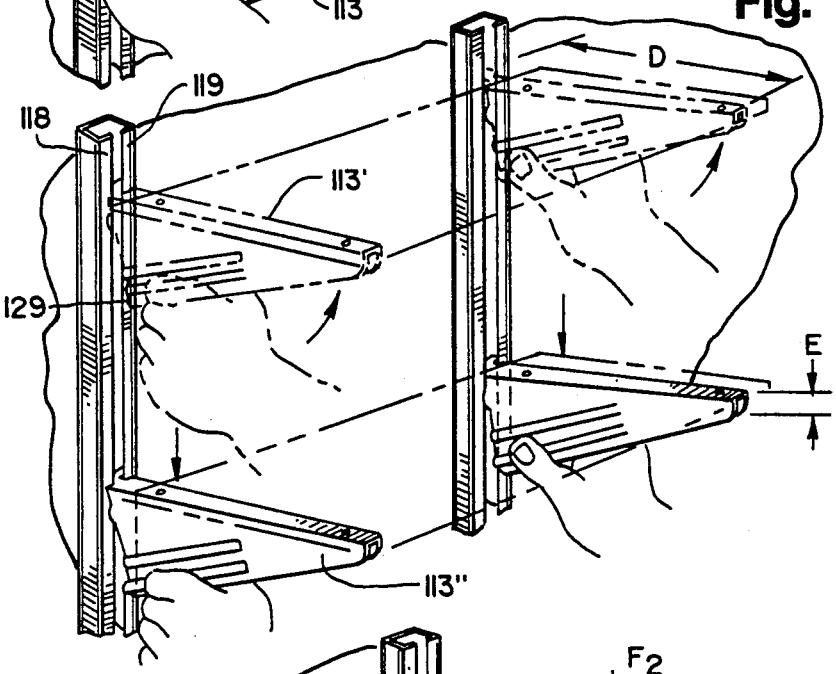
FIG. 14 is a view similar to FIG. 13 but shows the original position of the shelving in dotted line and the final position in solid line.

FIG. 14 is a successor view to that seen in FIG. 13 and the upper portion shows the brackets being pivoted upwardly to the 113' position—as about a horizontal axis—so as to disengage the hooks as at 129 from the wall portions 118, 119. When the hooks are completely disengaged as seen in the upper part of FIG. 14, the operation depicted in the lower part can be performed. There the brackets are shown in the process of being moved downwardly as by sliding loosely on the standards to the position 113".

Figure 15:
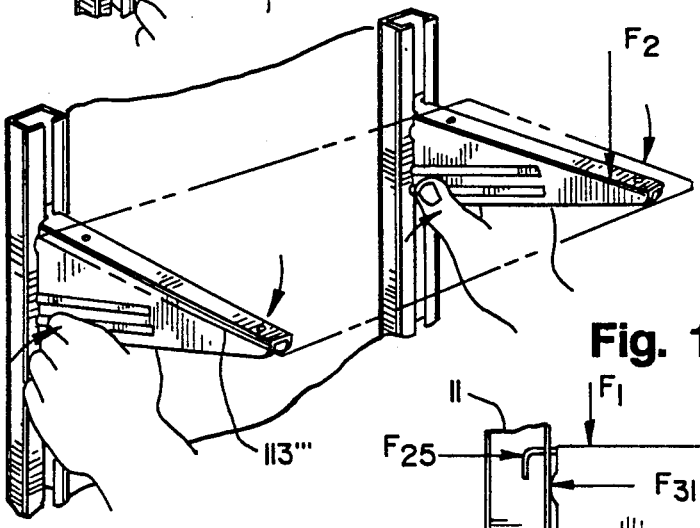
FIG. 15 is a view similar to FIG. 13 but shows the lower connection means being squeezed again incident to being inserted into the standard.

When a desired new location is achieved, the operation depicted in FIG. 15 is performed. There, the lower proximal ends of the brackets 113''' are squeezed so as to permit again insertion of the lower connection means into the standards. Thus, FIG. 15 is a view slightly later than that depicted in FIG. 14.

Figure 16:
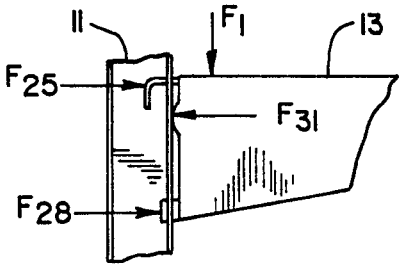
FIG. 16 is a schematic view like FIG. 3 showing the force distribution with a loading close to the standard.

Reference is now made to FIG. 16 which is a schematic representation of the showing in FIG. 3. Under a loading $F_1$ which is relatively close to the standard 11, the bracket 13 is subjected to three counter-balancing forces. The force exerted on the bracket by virtue of the upper connection means 25 is directed distally and is represented by the vector $F_{25}$ and this is opposed by the force exerted through the protuberances 31 and 32 represented by the proximally directed vector $F_{31}$. Also, the force under such a loading as at $F_1$ results in a distally directed force $F_{28}$ at the lower connection means.

Figure 17:
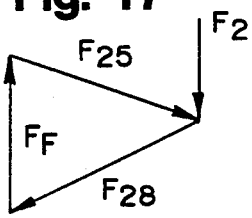
FIG. 17 is a free body diagram of the forces on the bracket under a substantially cantilevered load.

As the loading moves further away from the standard, i.e., distally, as to the position designated $F_2$ in FIG. 15, there is a reversal of force direction at the lower connection means and this is represented by the free body diagram shown in FIG. 17. The resultant of the two vectors $F_{25}$ and $F_{28}$ is designated $F_F$ which is effective to stabilize the system.

A significant advantage of the invention is the fact that, unlike prior art devices, the frictional engagement of the bracket with the standard increases as the loading increases. This then necessarily avoids slippage of the brackets on the standard which is the greatest fear in people cantilever supporting shelving on walls.

While in the foregoing specification a detailed description of an embodiment of the invention has been set down for the purpose of explanation, many variations in the details hereingiven may be made by those skilled in the art without departing from the spirit and scope of the invention.

I claim:

1. A support for shelving comprising a relatively elongated generally tubular standard having a longitudinally extending slot communicating the interior with the exterior, said standard having aligned, spaced apart wall portions defining said slot with each of said wall portions having interior and exterior surfaces, and a relatively elongated bracket having a proximal end positionably connected to said standard and a distal end spaced from said standard, said bracket including a horizontal bight and depending flanges, said bracket between said ends having surface means adapted to support shelving when said bracket has its length disposed horizontally, said bracket at its proximal end having vertically spaced apart upper and lower connection means, said upper connection means extending through said slot and having laterally horizontally-extending shoulders bearing against the interior surfaces of said wall portions, said lower connection means extending through said slot and having laterally horizontally extending hooks bearing against said standard wall portions, said bracket flanges at their proximal end each being equipped with a protuberance intermediate said upper and lower connection means in bearing engagement with the outer surfaces of said standard wall portions, whereby (a) when said shoulders are in bearing relation with said wall portions inner surfaces and (b) when said protuberances are just contacting said outer surface of said wall portions, said hooks are essentially outside said standard interior.

2. The support of claim 1 in which said standard has a generally rectangular cross section defined by front, rear and a pair of side walls, said front wall being equipped with said slot and including said aligned wall portions.

3. The support of claim 2 in which said rear wall is equipped with means for mounting said standard on a wall or the like.

4. The support of claim 2 in which said wall portions are double the thickness of the thickness of said rear and pair of sidewalls, said double thickness including folding each wall portion on itself adjacent said slot.

5. The support of claim 1 in which said protuberances are located within about the upper one-third of said bracket.

6. The support of claim 1 in which said upper connection means includes a T-shaped extension of said bight, said extension including a bar part remote from said bight and a neck part connecting said bar part to said bight, said bar part including said shoulders, said neck part having a length between said bar part and bight greater than the thickness of said wall portions, said neck part having a width less than said slot so as to enable said bracket to slide without frictional engagement on said standard when said protuberances and lower connection means are not contacting said standard.

7. The support of claim 1 in which each of said hooks is generally U-shaped in top plan view and including two sets of generally parallel distal and proximal legs, said distal legs being integral extensions of said flanges, an integral bight part connecting each distal legs to a proximal leg of each set, said proximal legs upon squeezing of said flanges together adjacent said lower connection means being adapted to pass through said slot so as to position the legs of each set in flanking relation to said wall portions.

8. The support of claim 1 in which said bracket has a lesser height at its distal end.

9. The support of claim 1 in which each of said bracket and standard is constructed of cold rolled steel.

10. The support of claim 9 in which the thickness of each of said bracket and standard is of the order of about 0.030" to about 0.060".

11. A support for shelving comprising a relatively elongated generally tubular standard having a longitudinally extending slot communicating the interior with the exterior, said standard having aligned, spaced apart wall portions adjacent said slot and of said wall portions having inner and outer surface and a relatively elongated bracket having a proximal end positionably connected to said standard and a distal end spaced from said standard, said bracket including a horizontal bight and depending flanges, said bracket between said ends having surface means adapted to support shelving when said bracket has its length disposed horizontally, said bracket at its proximal end having vertically spaced upper and lower connection means, said upper connection means including a T-shaped extension of said bight with the bar of said T-shaped to bear against the interior surfaces of said wall portion, said lower connection means including a U-shaped extension on each depending flange adapted to be positioned in flanking relation with said standard wall portions, said bracket at its proximal end also being equipped with protuberance means intermediate said upper and lower connection means in bearing engagement with the outer surfaces of said standard wall portions.

12. The support of claim 11 in which said upper connecting means includes a neck-like portion connecting said T-shaped bar to said bracket bight, said neck-like portion having a length greater than the thickness of said standard wall portions to permit sliding movement of said upper connection means without frictionally engaging said standard wall portions so as to avoid marring the same, said upper and lower connecting means and said protuberances cooperating to provide frictional engagement of said bracket with said standard irrespective of the location and magnitude of loading forces.

13. Infinitely adjustable shelving comprising an elongated standard having a generally C-shaped transverse section and also having a longitudinally extending continuous slot, a bracket releasably mounted on said standard and including a horizontally elongated member for coaction with said standard when said standard is mounted vertically, said bracket having a proximal end engaging said standard and a distal end spaced from said standard, said bracket proximal end having longitudinally extending vertically spaced apart integral connection means, both the upper and lower of said connection means exerting distally directed locking forces on said standard, said bracket having integral protuberance means in bearing relation with said standard and exerting proximally directed locking forces on said standard between said distally directed locking forces.

14. The shelving of claim 13 in which said bracket is channel shaped and having depending flanges connected by an upwardly facing bight, said bight being proximally extended to provide a T-shape constituting said upper connection means, each of said flanges being proximally extended adjacent said upper connection means to provide said protuberance means, each of said flanges being proximally extended to provide a U-shape facing away from the other flange so as to constitute said lower connection means.

15. A method of mounting a shelving support comprising the steps of providing a relatively elongated generally tubular standard having a longitudinally extending slot communicating the interior with the exterior and a relatively elongated bracket having an inverted U-shape in vertical section and a proximal end adapted to be positionably connected to said standard, said bracket at its proximal end having vertically spaced upper and lower connection means adapted to extend horizontally when said bracket is connected to said standard, orienting said bracket with said upper connection means disposed vertically and translating said bracket horizontally to insert said upper connection means into the interior of said standard through said slot, thereafter rotating said bracket approximately 90° about its longitudinal axis to position said lower connection means in alignment with said slot.

16. The method of claim 15 in which said lower connection means includes proximally extending hook means having a width less than the width of said slot when said bracket is transversely compressed, translating said hook means horizontally into the interior of said standard and while transversely compressing said bracket.

17. The method of claim 16 including providing said bracket with proximally extending protuberance means adjacent said upper connection means and contacting said protuberance means with said standard before said hook means is translated into the interior of said standard.

18. The method of claim 17 in which said contacting step occurs when the proximal ends of said hook means are generally aligned with the walls of said standard defining said slot.

19. The method of claim 17 including the step of sizing said protuberance means in relation to the size of said hook means so when said protuberance means is in just contacting relation with said standard the proximal ends of said hooks are just about to enter the interior of said standard.

* * * * *